United States Patent [19]

Merrick

[11] Patent Number: 4,833,752

[45] Date of Patent: May 30, 1989

[54] VACUUM MOP HEAD

[76] Inventor: John T. Merrick, 21 Westhaven Dr., Rochester, N.Y. 14624

[21] Appl. No.: 229,304

[22] Filed: Aug. 8, 1988

[51] Int. Cl.[4] ..... A47L 11/29

[52] U.S. Cl. ..... 15/322; 15/415 R

[58] Field of Search ..... 15/302, 320, 321, 322, 15/353, 364, 369, 392, 401, 415 R, 416, 418

[56] References Cited

U.S. PATENT DOCUMENTS

| | | | |
|---|---|---|---|
| 1,821,715 | 9/1931 | Kuchinsky | 15/322 |
| 1,929,345 | 10/1933 | Brown et al. | 15/322 X |
| 3,599,272 | 8/1971 | Merrick . | |
| 4,315,344 | 2/1982 | Woodward et al. | 15/415 R X |

*Primary Examiner*—Harvey C. Hornsby

*Assistant Examiner*—Corinne M. Reinckens

*Attorney, Agent, or Firm*—Stonebraker, Shepard & Stephens

[57] ABSTRACT

A vacuum mop head having a scrubbing pad, a front squeegee in a front vacuum pickup slot, and a rear squeegee in a rear vacuum pickup slot has a vacuum outlet divided effectively between the two pickup slots. Side walls of a vacuum passageway extend downward from the top of the mop head and are covered by a plate that supports a liquid detergent dispensing system and encloses the vacuum passageway from the vacuum outlet to the front vacuum pickup. The upper half of the vacuum outlet evacuates the vacuum passageway to the front vacuum pickup, and the lower half of the vacuum outlet directly evacuates the rear vacuum pickup.

12 Claims, 2 Drawing Sheets

VACUUM MOP HEAD

BACKGROUND

A vacuum mop, such as shown in my previous U.S. Pat. No. 3,599,272, dispenses liquid and detergent to a scrubbing pad that scrub mops the floor, while a vacuum, cooperating with squeegees on the mop head, picks up the liquid and dirt. I have now devised an improved mop head for such a vacuum mop, and my new mop head has a more effective pickup suction than my previous one. I have also accomplished this without adding significantly to the expense of the mop head, so that my new vacuum mop can sell for the same price and yet perform better.

SUMMARY OF THE INVENTION

My previous U.S. Pat. No. 3,599,272 suggested a vacuum mop head with a vacuum outlet that evacuated a large area under the top of the mop head. The evacuated area extended from one side to another of the mop head and extended along the full width of the front and rear vacuum pickup slots. My new vacuum mop head improves on this by evacuating a much smaller area under the top of the mop head so that the evacuated air is kept moving at a high velocity, and the suction applied to the front and rear vacuum pickups is more powerful. This makes the vacuum mop head aggressive at picking up dirt and moisture, to leave the floor clean and practically dry on each stroke.

The narrow vacuum passageway of my new mop head preferably has side walls formed in a casting of the mop head, so that the side walls extend down from the top of the mop head. The space between the side walls is covered by a plate that encloses the vacuum passageway and also supports the water and detergent dispenser. The plate divides the vacuum outlet into a lower half directed to the rear pickup and an upper half directed to the forward pickup through the vacuum passageway. The front and rear squeegees are preferably fixed in place in the front and rear pickup slots. Both of these are vigorously evacuated, directly to the vacuum outlet from the rear pickup, and through the vacuum passageway to the vacuum outlet for the front pickup. The side regions under the top of the mop head are not evacuated, but the scrubbing pad is wetted throughout its width and length so it can accomplish its scrubbing action.

DRAWINGS

DETAILED DESCRIPTION

Figure 4:
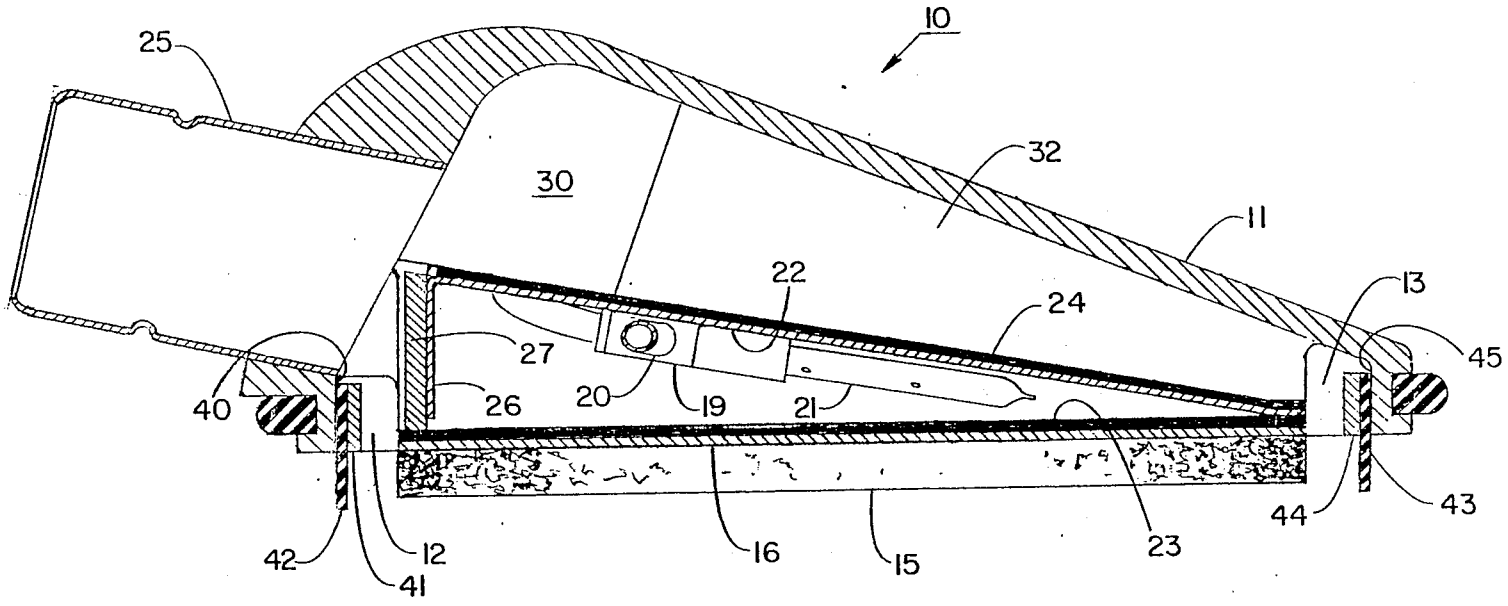
FIG. 4 is an enlarged cross-sectional view of the assembled vacuum mop head of FIG. 1, taken along the line 4—4 thereof.

Vacuum mop head 10, as shown in the drawings, preferably includes a casting 11 providing a rear vacuum pickup slot 12, and a front vacuum pickup slot 13 extending along respective rear and front edges of mop head 10. A scrubbing pad 15, preferably formed of a foamed resin material, is secured, preferably by hook and loop pile fasteners, to scrubbing pad plate 16, which, as shown in FIG. 4, is fastened to casting 11 between vacuum pickups 12 and 13.

Figure 1:
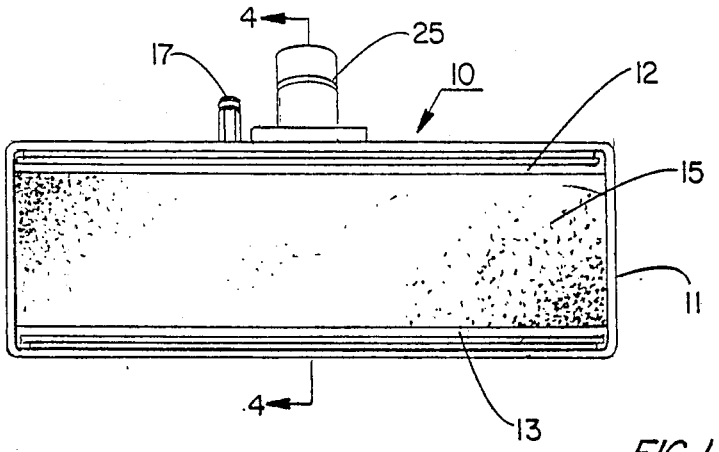
FIG. 1 is a bottom view of a preferred embodiment of my vacuum mop head.
Figure 2:
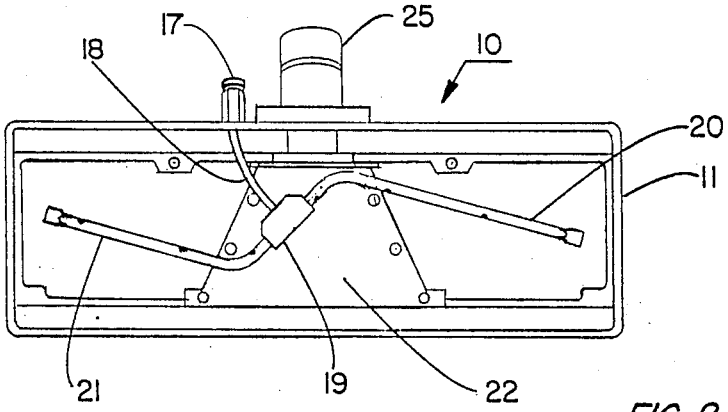
FIG. 2 is a bottom view of the vacuum mop head of FIG. 1, with the scrubbing plate and the front and rear squeegees removed.

Scrubbing pad 15 and its supporting plate 16 are shown removed from mop head 10, in FIG. 2, to reveal the liquid detergent dispensing system. This includes an inlet fixture 17, a preferably flexible inlet tube 18, and a T-block 19, fastened to plate 22, to support a pair of perforated dispenser tubes 20 and 21, extending outward above scrubbing pad plate 16. Plate 16 is perforated so that scrubbing liquid from dispenser arms 20 and 21 passes through openings in plate 16 and wets scrubbing pad 15, which scrubs the floor with the aid of the liquid detergent. The person operating the vacuum mop that includes mop head 10 controls the dispensing of liquid through tubes 20 and 21, by operating a trigger at a wand handle (not shown).

Figure 3:
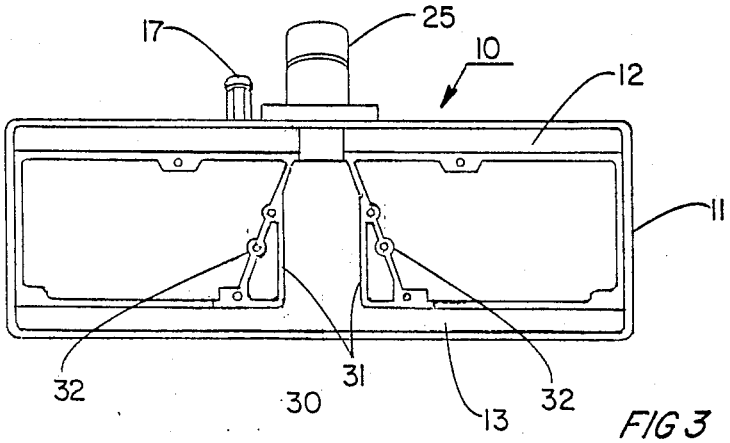
FIG. 3 is a bottom view of the vacuum mop head of FIGS. 1 and 2, with the water and detergent dispenser, and its supporting plate, removed.

With plate 22 and the liquid detergent dispensing system removed, as shown in FIG. 3, vacuum passageway 30 is visible on the underside of the top of casting 11. Vacuum passageway 30 extends from front vacuum pickup 13 to a vacuum outlet 25, which is connectable to a wand (not shown) for moving mop head 10 about. Vacuum passageway 30 is arranged between side walls 31, which along with walls 32 are preferably formed as part of casting 11. They extend downward from the top of casting 11 where they confine vacuum passageway 30 to a central region spaced well inward from the side edges of mop head 10. Walls 31 and 32 also preferably terminate in a plane that angles downward from vacuum outlet 25 to front pickup slot 13. Plate 22 can then cover over and be fastened to walls 31 and 32 to enclose vacuum passageway 30, from vacuum outlet 25 to front pickup slot 13.

The air, liquid, and dirt picked along front pickup slot 13 moves to the center of mop head 10 and flows along vacuum passageway 30 within inner walls 31, toward vacuum outlet 25. The small area of vacuum passageway 30 keeps this flow moving at a substantial velocity, which was not true when the entire region under the top of casting 11 was evacuated as suggested in my previous patent.

I prefer that gasket material 23, as shown in FIG. 4, be arranged around the periphery of scrubber pad plate 16 so that gasket 23 is interposed between casting 11 and plate 16, to seal plate 16 securely to casting 11. I also prefer that gasket 24 be interposed between plate 22 and walls 31 and 32 for sealing plate 22 effectively to casting 11. Gaskets 23 and 24 ensure that all the air evacuated from mop head 10 is confined to rear pickup 12, front pickup 13, and vacuum passageway 30.

Plate 22, when mounted at the preferred angle as shown in FIG. 4, divides vacuum outlet 25 approximately in half. The upper half of vacuum outlet 25 communicates with vacuum passageway 30, and the lower half of vacuum outlet 25 communicates directly with rear vacuum pickup 12. Vacuum passageway 30 communicates directly with front vacuum pickup 13, so that the vacuum provided at outlet 25 is approximately evenly divided between rear pickup slot 12 and front pickup slot 13.

Plate 22 preferably has a bent portion 26 that extends downward from vacuum outlet 25 toward scrubbing pad plate 16, along a forward wall of rear pickup slot 12. A block 27, secured to plate portion 26, supports gasket material 23 and closes what otherwise would be a central gap in the forward wall of rear pickup 12.

A rear squeegee 42, held by a squeegee bar 41, is fastened to a rear wall 40 of rear vacuum pickup 12; and a front squeegee 43, held by a squeegee bar 44, is fastened to a front wall 45 of front vacuum pickup slot 13. Both squeegees 42 and 43 extend to the level of the bottom of scrubbing pad 15, where they squeegee liquid and dirt as mop head 10 is stroked back and forth.

When mop head 10 moves forward, both squeegees 42 and 43 bend rearwardly. As this happens, front squeegee 43 bends back to constrict air flow through front vacuum pickup 13, and rear squeegee 42 bends back as it squeegees liquid and dirt ahead of it. The constriction of front vacuum pickup 13 by front squeegee 43 makes the vacuum pickup in rear slot 12 more vigorous; and since rear squeegee 42 is pushing liquid and dirt ahead of it, in the vicinity of rear pickup 12, the vigorous vacuum there helps suck up the liquid and dirt to leave the floor practically dry behind mop head 10 on a forward stroke. A similar but opposite effect occurs on a rearward stroke of mop head 10. This bends both squeegees 42 and 43 forward, with front squeegee 43 moving liquid and dirt ahead of it. Rear squeegee 42 then constricts air flow through rear vacuum pickup 12 so that the suction is stronger at front vacuum pickup 13. There, liquid and dirt squeegeed up by front squeegee 43 is drawn into front vacuum pickup 13, leaving the floor practically dry in the path of vacuum mop 10, as it moves rearwardly. The squeegees and vacuum system thus cooperate to clean up liquid and dirt on each stroke of mop head 10, so that these disappear as mop head 10 works.

The pickup suction produced by mop head 10 is noticeably stronger than the pickup suction produced by the mop head suggested in my U.S. Pat. No. 3,599,272. The suction did not pull as hard in my previous mop head, and it left the floor noticeably wetter. The improved suction of mop head 10 powerfully engages the floor and leaves it practically dry, so that wet vacuum mopping is fast, effective, and finished as mop head 10 strokes back and forth across a floor.

I claim:

1. In a vacuum mop head having a housing with a scrubbing pad on a bottom surface, means for wetting said scrubbing pad with a liquid detergent, a rear vacuum pickup extending rearwardly of said scrubbing pad along a rear edge of said housing, a forward vacuum pickup extending forward of said scrubbing pad along a forward edge of said housing, and a vacuum outlet connectable to a vacuum wand at a rear region of said housing, the improvement comprising:

a. said housing having sides of a vacuum passageway formed to extend downward from a top of said housing and extending forward from said vacuum outlet to said forward vacuum pickup, said passageway sides being arranged in a central region of said housing spaced inward from end regions of said housing;

b. a plate secured to said housing to span the space between said passageway sides for enclosing said vacuum passageway from said vacuum outlet to said forward vacuum pickup;

c. said plate extending from the region of said forward vacuum pickup to the region of said vacuum outlet, where said plate divides said vacuum outlet into upper and lower halves;

d. said lower half of said vacuum outlet communicating with said rear vacuum pickup for evacuating said rear vacuum pickup; and e. said upper half of said vacuum outlet communicating with said vacuum passageway and said forward vacuum pickup for evacuating said forward vacuum pickup.

2. The improvement of claim 1 including a rear squeegee fixed in place within said rear vacuum pickup and a forward squeegee fixed in place within said forward vacuum pickup.

3. The improvement of claim 2 wherein said rear squeegee is fixed to a rear wall of said rear vacuum pickup and bends forward to constrict air flow through said rear vacuum pickup on a rearward stroke of said vacuum mop head, and said forward squeegee is fixed to a forward wall of said forward vacuum pickup and bends rearward to constrict air flow through said forward vacuum pickup on a forward stroke of said vacuum mop head.

4. The improvement of claim 1 wherein said scrubbing pad wetting means if mounted on an underside of said plate covering said vacuum passageway.

5. The improvement of claim 1 wherein said tip of said housing and said sides of said vacuum passageway are formed as an integral casting.

6. The improvement of claim 1 wherein said plate is secured to said passageway sides.

7. The improvement of claim 1 wherein said plate is generally flat and inclined downward from said vacuum outlet to said forward vacuum pickup.

8. A vacuum system for a vacuum mop head having a cast housing with a front vacuum pickup along a front edge and a rear vacuum pickup along a rear edge, a vacuum outlet connectable to a vacuum wand at a rear region of said housing, a scrubbing pad arranged between said front and rear vacuum pickups in a lower region of said head, means for dispensing liquid detergent onto said scrubbing pad, a front squeegee arranged in said front vacuum pickup, and a rear squeegee arranged in said rear vacuum pickup, said vacuum system comprising:

a. an upper region of said housing under a top wall of said housing having a narrow vacuum passageway confined between side walls extending downward from said top wall, said vacuum passageway leading form said vacuum outlet along a central region of said housing where said side walls are spaced inward from end regions of said housing to communicate with said front vacuum pickup;

b. a plate secured to said housing and extending between said side walls for covering said vacuum passageway to enclose said vacuum passageway from said front vacuum pickup to said vacuum outlet;

c. said dispensing means for said detergent being mounted on an underside of said plate;

d. said plate extending to said vacuum outlet where said plate is disposed for dividing said vacuum outlet into an upper half and a lower half;

e. said upper half of said vacuum outlet communicating with said vacuum passageway and said front vacuum pickup; and f. said lower half of said vacuum outlet communicating with said rear vacuum pickup.

9. The vacuum system of claim 8 wherein said squeegees are fixed in place in said forward and rear pickups.

10. The vacuum system of claim 9 wherein said forward squeegee is fixed to a forward wall of said forward pickup and bends rearward on a forward stroke of said vacuum mop head to constrict air flow through said forward pickup, and said rearward squeegee is fixed to a rear wall of said rear pickup and bends forward on a rearward stroke of said vacuum mop head to constrict air flow in said rearward pickup.

11. The vacuum system of claim 8 wherein said side walls of said vacuum passageway are cast into said top region of said housing.

12. The vacuum system of claim 8 wherein said plate is secured to said side walls of said passageway.

* * * * *